United States Patent [19]

Martin et al.

[11] 4,044,836

[45] Aug. 30, 1977

[54] AXIAL COMPRESSION POWDER DISPENSER

[76] Inventors: Edward J. Martin, 17 Deerfield Road; Joseph M. Minkevitch, 26 Folan Ave., both of Norwood, Mass. 02062

[21] Appl. No.: 654,718

[22] Filed: Feb. 2, 1976

Related U.S. Application Data

[63] Continuation-in-part of Ser. No. 525,226, Nov. 19, 1974, abandoned, which is a continuation-in-part of Ser. No. 419,790, Nov. 28, 1973, abandoned.

[51] Int. Cl.[2] ..... A62C 21/00

[52] U.S. Cl. ..... 169/30; 222/215; 239/327

[58] Field of Search ..... 239/327, 328; 222/206, 222/212, 215; 169/30, 35, 33

[56] References Cited

U.S. PATENT DOCUMENTS

| | | | |
|---|---|---|---|
| 2,731,093 | 1/1956 | Gordon | 222/215 X |
| 2,764,319 | 9/1956 | Weimer | 222/215 |
| 2,899,110 | 8/1959 | Parker | 222/215 |
| 3,143,429 | 8/1964 | Swanson et al. | 222/215 X |
| 3,162,371 | 12/1964 | Palmer et al. | 239/327 |
| 3,340,869 | 9/1967 | Bane | 222/215 X |
| 3,390,821 | 7/1968 | Mullan | 222/215 X |
| 3,572,443 | 3/1971 | Guise | 169/77 X |
| 3,889,754 | 6/1975 | Dunn | 169/77 X |

FOREIGN PATENT DOCUMENTS

| | | | |
|---|---|---|---|
| 568,910 | 7/1958 | Belgium | 239/327 |

*Primary Examiner*—Evon C. Blunk
*Assistant Examiner*—Michael Mar
*Attorney, Agent, or Firm*—Bessie A. Lepper

[57] ABSTRACT

A dispenser for dry powders, and in particular for fire extinguishing powders, formed as a container having a handle/nozzle section to be gripped by one hand, a hand gripping section to be gripped by the other hand, and a central bellows section for alternate axial compression and expansion to pump the powder from the container and thereby to discharge it in repeated cloud-like bursts. By regulating the quantity of powder in the dispenser and the powder dispensing opening it is possible to repeatedly discharge fire extinguishing effective amounts of a fire extinguishing powder. In one preferred embodiment the handle/nozzle section is configured as an elongated conical member.

27 Claims, 16 Drawing Figures

AXIAL COMPRESSION POWDER DISPENSER

CROSS REFERENCES

This application is a continuation-in-part of our application Ser. No. 525,226, filed Nov. 19, 1974, entitled "AXIAL COMPRESSION POWDER DISPENSER" now abandoned which in turn is a continuation-in-part of our application Ser. No. 419,790, filed Nov. 28, 1973, entitled "AXIAL COMPRESSION POWDER TYPE FIRE EXTINGUISHER" and now abandoned.

BACKGROUND OF THE INVENTION

It has long been known to provide hand holdable containers for fire-extinguishing liquids adapted to be broken for dispensing the contents, as in U.S. Pat. No. 2,865,458 to Simoncini of Dec. 23, 1958, U.S. Pat. No. 2,772,744 to Beadet of Dec. 4, 1956, or to be released at predetermined temperatures, as in U.S. Pat. No. 2,857,971 to Ferris of Oct. 28, 1958. Collapsible tubes have also been proposed for dispensing fire extinguishing liquid, as in U.S. Pat. No. 1,850,008 to Gore of Mar. 15, 1932.

Since liquid may tend to spread a fire of certain types, rather than to extinguish the flames, powder type extinguishers are often found more useful and efficient, such extinguishers being exemplified in U.S. Pat. No. 2,731,093 to Gordon of Jan. 17, 1956. In the Gordon device the container is about three-quarters full of powder, the dispensing passage is relatively narrow in diameter, e.g., no more than about 5/32 inch, and dispensing is by manual squeezing of the flexible walled container in the hourglass shaped midriff or central portion, the squeezing being toward the central longitudinal axis.

There are on the market fire extinguishers for dispensing powdered fire extinguishants comprising a plastic container having a bellows section to effect a pumping action. However, the embodiments of such fire extinguishers known to applicants are not effective in extinguishing many common household fires due to, among other reasons, the fact that they have very narrow slotted discharge openings, and relatively stiff bellows sections which can be compressed only to the extent that the ratio of compressed bellows length to expanded bellows length is about 1 to 2. These devices of the prior art are illustrated in FIGS. 13–16 and described in some detail inasmuch as no patents describing them have been located.

It is therefore a primary object of this invention to provide an improved dry powder dispenser which is hand-held and hand-operated and capable of being pumped to discharge a cloudlike burst of the powder onto a predetermined area. Another object of this invention is to provide a novel fire extinguisher capable, through hand pumping, of discharging fire extinguishing effective amounts of a dry extinguishant in repeated cloud-like bursts. Yet a further object of this invention is to provide a fire extinguisher of the type described which is easily operated, relatively inexpensive to construct and particularly suitable for placement in many different locations within the home. Other objects of the invention will in part be obvious and will in part be apparent hereinafter.

SUMMARY OF THE INVENTION

The dry powder dispenser of this invention, which is hand-held and hand-operable, comprises a container having a handle/nozzle section terminating in a powder dispensing opening and a hand gripping section jointed by a central, thin-walled, flexible bellows section. The handle/nozzle section, preferably in the form of an elongated conical member, is adapted to fit one hand of an operator while he grips the hand gripping means with his other hand. The operator can then pump the central bellows section to dispense powder in repeated cloud-like bursts. The powder dispensing opening terminating the handle/nozzle section must be so sized as to permit the discharge of an effective amount of powder to create the desired cloud-like burst when the central bellows section is contracted. This powder dispensing opening must also be sized to permit, during the expansion of the central bellows section, the intake of a sufficient quantity of air to entrain the amount of powder required to create the next succeeding cloud-like burst. To provide for the initial presence and subsequent intake of a quantity of air sufficient to create the required cloud-like bursts of powder, the powder dispenser of this invention is initially only partially, e.g., about one-half, filled with the pwoder to be dispensed.

As will be apparent from the following detailed description of the dispenser of this invention, the configurations of the handle/nozzle and the hand gripping sections may vary, and various closure/sealing means may be used depending upon the use of the device. In the case where the device is used as a fire extinguisher, the powder contained may be any finely divided, free flowing solids mixture of an effective fire extinguishing material, normally containing such compounds as sodium bicarbonate, ammonium phosphate, potassium chloride, potassium bicarbonate, and any necessary additives, e.g., those used to prevent caking and packing.

BRIEF DESCRIPTION OF DRAWINGS

For a fuller understanding of the nature and objects of the invention, reference should be had to the following detailed description taken in connection with the accompanying drawings in which.

DESCRIPTION OF A PREFERRED EMBODIMENT

Although the dispenser of this invention may be used for dispensing any finely divided solid powder, it is particularly suitable as a fire extinguisher and it will therefore be described hereinafter in that capacity.

Figure 2:
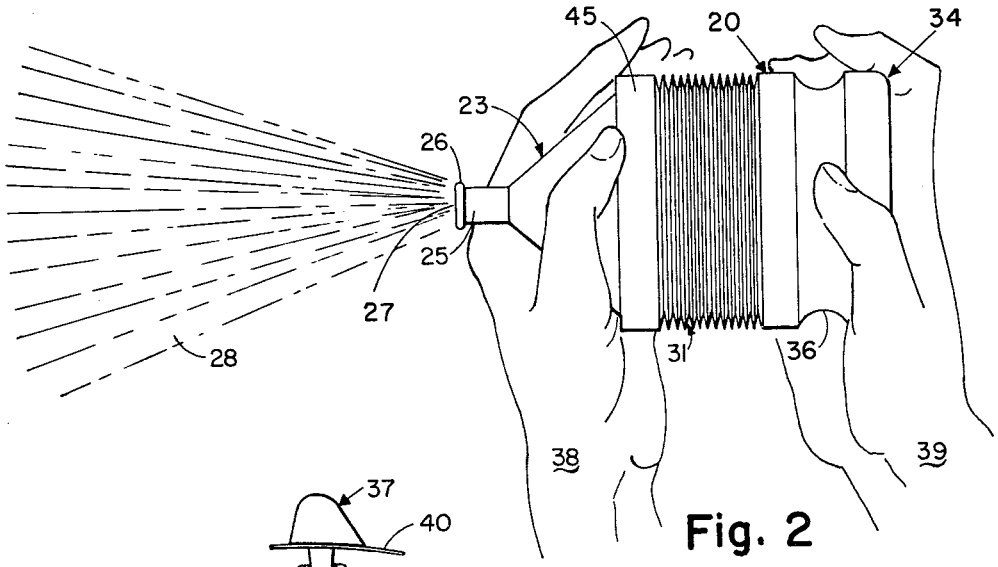
FIG. 2 is a view of the dispenser of FIG. 1 showing the central bellows portion compressed in an axial direction to pump out a cloud of powder.

As shown in the drawings, the fire extinguisher or other powder dispenser of this invention includes a container body 20, preferably formed of a resilient, deformable plastic, adapted to be held in the hands 38 and 39 of the user as shown in FIG. 2.

Figure 1:
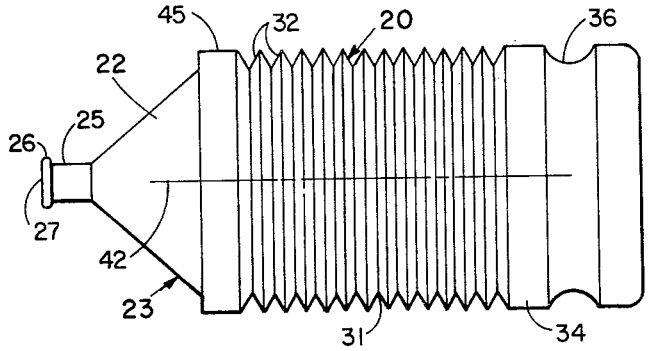
FIG. 1 is a side elevational view of one embodiment of a powder dispenser constructed in accordance with this invention showing it in a normal expanded condition.
Figure 3:
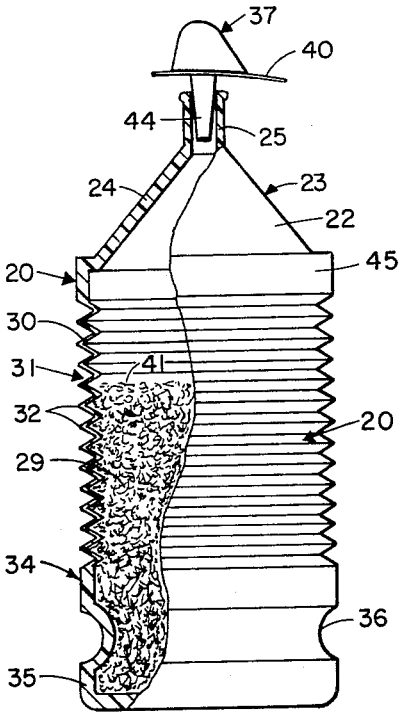
FIG. 3 is a side elevational view of the dispenser embodiment of FIG. 1, partly in cross section, showing the charge within the dispenser and the construction of this embodiment of the dispenser.

Body 20 includes a handle/nozzle section 23 which in the embodiment of FIGS. 1–3 comprises a truncated handle portion 22 and a cylindrical nozzle portion 25, with a rim bead 26, all of a relatively thick-wall 24 (FIG. 3) of a suitable plastic. The nozzle section 25 provides a powder dispensing opening 27 of a diameter of such a size as to permit a sufficiently large amount of powder 29 (FIG. 3) to be entrained in the air and discharged from the dispenser to provide a powder cloud of the desired density and concentration over a desired area. In the case where the dispenser is used as a fire extinguisher, cloud 28 must be a fire-extinguishing effective cloud of the solid powder extinguishant. Typically, the inside diameter of the powder dispensing opening 21 will be at least $\frac{3}{8}$ inch. Since the handle/nozzle section 23 has as one of its purposes that of providing a grip for one hand of the operator (as shown in FIG. 3) it must be of a size, diameter and length, to permit grasping it with one hand.

It is essential that opening 27 be unobstructed, that is, that this opening does not have any slit-defining diaphragm or any other means to limit its cross sectional area or configuration. Moreover, it is preferable that the internal wall of the discharge end of the handle/nozzle section be smoothly configured without sharp breaks and that powder dispensing opening 27 has a cross sectional area and configuration conforming to that of the handle/nozzle section at its discharge end.

Integral with handle/nozzle section 23 is a central bellows section 31 of cylindrical configuration and having axially compressible pleats 32 formed of a relatively thin-walled material such as a plastic. Forming bellows section 31 of relatively thin walled material gives this pumping section of the powder dispenser great flexibility and ease of pumping action. By forming pleats 32 of the bellows section to have sharp edges as shown, the buildup of a desirable back pressure is created within the dispenser. Integral with central bellows section 31 on the end opposite to that to which the handle/nozzle section is attached is a hand gripping section 34. In the embodiment of the dispenser shown in FIGS. 1–3, this hand gripping section 34 is shown to be formed as a relatively thick-walled, closed-end cylinder 35 which has a wide, deep annular finger groove 36 thus providing for gripping this end of the dispenser with the other hand in a manner to permit the necessary-pummping action. Since the purpose of the dispenser of this invention is to provide a predetermined quantity of a solid powder over a selected area from a short distance, e.g., at least about four feet for a fire extinguisher, it is necessary that the handle nozzle section be so configured (both with regard to length and cross section) and that the central bellows section be long enough to accomplish this purpose.

One embodiment of a closure/sealing means is illustrated in detail in FIG. 3 This closure/sealing means 37 includes an enlarged flange gripping portion 40 and a tapered lower portion 44 which slidably fits into powder dispensing opening 27 in nozzle section 25 with a wedging friction fit to serve as a moisture seal which is readily removable by withdrawal when the dispenser is to be used.

As shown in FIG. 3, the dispenser is preferably initially charged with the powder to be dispensed up to a level 41 such that it achieves a predetermined desired quantity of the powder in the dispenser container and leaves an unfilled volume therein. The purpose of leaving an appreciable amount of unfilled volume within the dispenser is twofold. Thus the amount of powder in the dispenser should be such as to ensure the presence of sufficient air within the dispenser prior to the contraction of bellows 31 to carry a sufficient amount of powder 29 to form an effective fire extinguishing cloud 28. Also, the amount of powder in the dispenser should be such as to permit powder dispensing opening 27 to be sufficiently clear of powder during that portion of the pumping when the bellows are being expanded and air is being taken in for the succeeding discharge of additional powder.

As an example, powder level 41 may be such as to about half fill the dispenser when it is to be used as an all purpose household fire extinguisher. Exemplary of a suitable fire extinguishing powder is monoammonium phosphate containing chemical additives to render it noncaking, nonpacking and free-flowing. Various fire extinguishing powders are well known in the art and are not a part of this invention. The powder is stored in the lower portion of the dispenser when the extinguisher is vertical, but it falls toward the level of the axial center line 42 when the container is being used, e.g., tilted downwardly or even held more nearly horizontally.

Thus, instead of the powder blocking the powder dispensing opening 27 when the extinguisher is held with the handle/nozzle section 23 in one hand 38 and the hand gripping means section 34 in the other hand 39, dispensing opening 27 is substantially unobstructed so that as the central bellows section 31 is compressed in an axial direction, the air within the container blows over the charge to dispense the powder in a cloud-like burst. Upon retraction of the bellows, fresh ambient air is freely drawn inwardly through dispensing opening 27 for the next pumping stroke or cycle.

Since the handle/nozzle section of the dispenser must provide for obtaining a firm grip with one hand and for sufficient rigidity in this section to maintain the integrity of the nozzle shape during pumping, the handle/nozzle section 23 of the embodiment of FIGS. 1–3 includes a thick-walled band 45 terminating the truncated handle portion 22 to serve as a finger grip and lend some rigidity when the extinguisher is compressed, the diameter of band 45 being essentially equal to the outside diameter of central bellows section 31.

Figure 4:
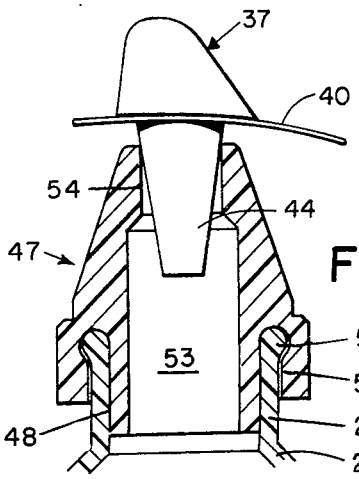
FIG. 4 is a cross sectional detail of one embodiment of a closure/sealing means showing the use of a filling adapter suitable for the dispenser of FIG. 1.

In the closure/sealing means embodiment shown in FIG. 4, the closure/sealing means 37 includes a filling adapter 47 which is provided to permit the opening 48 in nozzle section 25 to be of proper size to conform to commercially available bottle-filling apparatus, for example about one and one-quarter inches inside diameter.

Thus, the extinguisher can be filled with powder at high speed on conventional machinery whereupon the adapter 47, preferably formed of deformable plastic, may be slidably fitted over the outwardly projecting bead 51 which terminates nozzle section 25 so that the inwardly projecting collar 52 on adapter 47 will snap lock into place, without requiring threads. The passage 53 within adapter 47 serves as a funnel and as an extension of nozzle section 25 and provides powder dispensing opening 54 of a suitable diameter. Use of the snap lock adapter 47 is preferable to providing a large top, or bottom, filling opening in body 21, which might rupture under pumping pressure from the bellows to spill the contents.

As will be seen from FIG. 3, the dispenser of this invention exclusive of the sealing/closure means, is preferably formed as a single integral unit such, for example, as by molding it from a suitable plastic in accordance with well developed techniques.

As noted previously, the dispenser of this invention may be used to discharge successive clouds of insecticide, or other powders, as well as fire extinguishing powder. As an example of the performance of the dispenser of this invention constructed in the manner shown in FIGS. 1–3, it may be pointed out that when filled about one-half full of a commercially available monoammonium phosphate-based fire extinguishant it is capable of extinguishing a 1B fire as defined by Underwriters Laboratories U.L. 711 Standard for Safety (Fire Extinguisher, Rating and Fire Testing Of).

The actual dimension of the powder dispensing opening will depend, at least to some extent, on the use to which the dispenser is to be put, e.g., the distance the operator is from the area to be contacted by the powder cloud and the cloud coverage area desired. For example, a powder dispensing opening of about ⅜ inch diameter has been found to create a sufficient back pressure, or cloud trajectory, to satisfy the powder insecticide market, while one having a diameter of about one-half inch is satisfactory for a household fire extinguisher.

Figure 5:
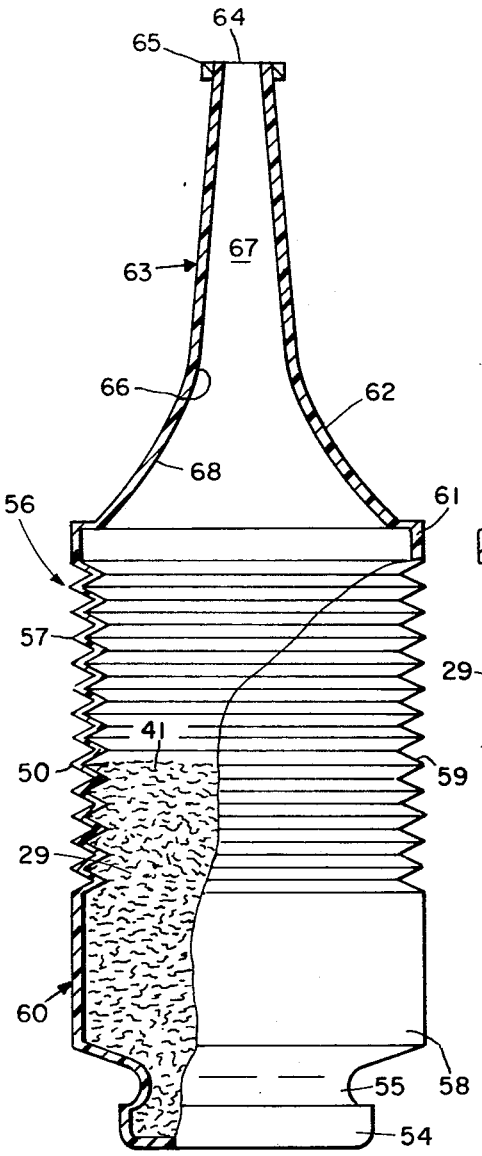
FIG. 5 is a side elevational view, partly in cross section, of another embodiment of a powder dispenser constructed in accordance with this invention.

Another embodiment of the dispenser of this invention is shown in FIG. 5. This embodiment is particularly suited for large-sized dispensers, e.g., to hold up to about 5 pounds of powder. In the embodiment of FIG. 5, the handle/nozzle section 63 is faired so that the handle portion 62, originating in thinwalled band 61, becomes smoothly integral at its base 66 with nozzle portion 67. The handle/nozzle section 63 terminates in a powder dispensing opening 64 which may be encircled by an annular collar 65 adapted for use with a snap-on closure/sealing means. Since in some instances it is preferable that the closure/sealing means are of a type which are not reusable or replaceable to prevent reuse of a partially loaded charge, the annular collar 65 provides a should under which a crown type closure may be anchored. Such a closure may have a strip tab, or the like, so that once the tap is stripped off, the closure cannot be replaced. The collar 65 may also, of course, be located below the level of powder dispensing opening 64. The closure is preferably air-tight.

The dispenser 56 of FIG. 5 is similar in structure to the dispenser 20 of FIGS. 1–3 in having a one-piece, plastic body 57, a hand gripping section 60 and a thinwalled central bellows section 59 formed on sharp angular pleats 50 which resemble saw teeth and which, as previously noted, have been found to close up more closely than round-edged, thick-walled bellows and to require less compression pressure than such bellows of the prior art.

In the dispenser of FIG. 5, the hand gripping section, generally indicated by the reference numeral 60, includes a cylindrical powder storage portion 58, an annular finger groove 55 and a palm-engaging portion 54. In those embodiments of the dispenser where a significant amount of the powder is stored in the hand gripping section such as in FIG. 5, the length of the central bellows section, in relationship to the length of the two other sections, must be sufficient to provide the required pumping action to discharge large enough cloud-like bursts of the powder. It will also be appreciated that in the large-sized dispensers such as shown in FIG. 5, some reduction in diameters in the palm engaging portion 54 and finger groove 55 of the hand gripping section 60 may be required so that it can fit comfortably in the average-sized hand. The relatively long cylindrical powder storage portion 58 offers an external surface suitable for attaching a label, instructions and the like.

As will be seen in FIG. 5, it is not necessary to form the hand gripping section 60 of walls any thicker than used to form the central bellows section, for the powder contained in this section contributes rigidity to the section.

For exemplary purposes only, the following are given as typical dimensions for a larger-sized dispenser as illustrated in FIG. 5. The powder dispensing opening 64 of handle/nozzle section 63 may be about one-half inch in inside diameter and the nozzle section 67 may be about 4–3/16 inch in length from its base 66 where it merges with the top of the handle portion 62, and the overall handle/nozzle section 63 may be about 6¼ inch in length. Further, with regard to exemplary dimensions for the embodiment of FIG. 5, the combined length of the central bellows section and hand gripping section may be about 8½ to 10 inches and the maximum diameter of these sections may be about 4½ inches.

In the embodiment of FIG. 5, the taper of handle/nozzle section 67, the friction generated by the inner face 68 thereof, the length of nozzle section 67, and the diameter of powder dispensing opening 64 all contribute to the ability of dispenser 56 to produce enough back pressure and flow guidance to discharge one of more clouds of powder held in a suitable position, e.g., at an angle of about 45° which will readily extinguish fires.

As in the case of the embodiment of FIGS. 1–3, the length and configuration of handle/nozzle section 63 are such as to contain in a tilted position sufficient powder and to develop sufficient back pressure to produce a cloud-like burst to meet the predetermined requirements for amount of powder discharged and final distribution area of the powder at a given distance. The dispenser embodiment of FIG. 5 when used as a fire extinguisher is capable of extinguishing classes 1B and 2B fires as defined in U.L. 711 Standard for Safety.

Figure 6:
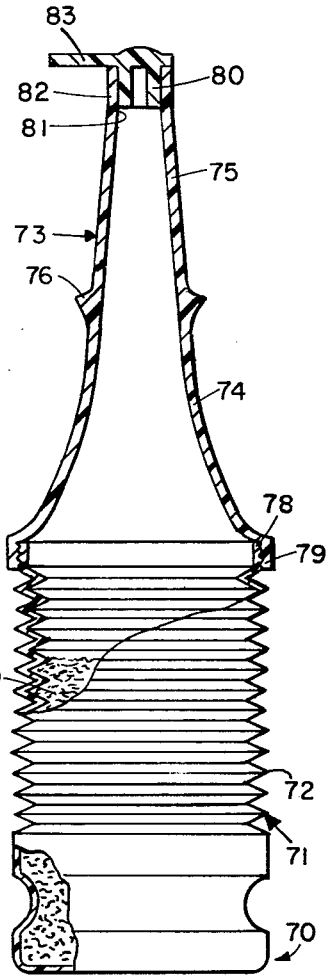
FIG. 6 is a side elevational view, partly in cross section, of yet another embodiment of a powder dispenser of this invention having a perferred type of closure/-sealing means.

FIG. 6 illustrates another possible configuration for a household fire extinguisher. The dispenser 71 has a hand gripping section 70, constructed as in the embodiment of FIGS. 1–3 except that a thin wall is used; a central bellows section 72; and a handle/nozzle section 73 faired as in the embodiment of FIG. 5 to provide a smoothly connected handle portion 74 and a nozzle portion 75. Optionally, an integral rib or shoulder 76 may be located about midway along the length of handle/nozzle section 73 to provide extra means to obtain a firm grip by the hand engaging the handle/nozzle section. The embodiment of FIG. 6 may be used to extinguish class 1B fires.

When used as a household fire extinguisher, the embodiment of FIG. 6 may have the following dimensions which are given as illustrative and are in no way meant to be limiting. The combined length of the hand gripping means section 70 and central bellows section may be about 6 inches, and these sections may have a maximum diameter of about 3½ inches. The handle/nozzle section may also have a total length of about 6 inches with the nozzle portion making up about 4¼ inches of this length. Finally, the powder dispensing opening may have a diameter of about ½ inch.

It will be seen in FIG. 6 that it is possible to construct handle/nozzle section 73 as one unit or piece and the remaining part of the dispenser (bellows section 72 and hand gripping section 70) as another unit or piece. To do this, the short cylindrical band 78 which terminates bellows section 73 is externally threaded and handle/-nozzle section 73 is provided with a terminal cylindrical band 79 sized and internally threaded to engage the external threads on band 78. Thus it is a simple matter to screw the two parts together to form a sealable dispenser. It is also, of course, within the scope of this invention to construct the dispenser of FIG. 6 in one piece as described above for FIGS. 3 and 5 or to construct the embodiments of FIGS. 3 and 5 in two units and provide other suitable means to sealably join the two units including snap-on arrangements.

Figure 7:
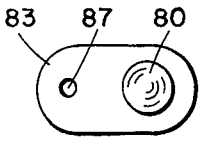
FIG. 7 is a top plan view of the closure/sealing means of FIG. 6.
Figure 8:
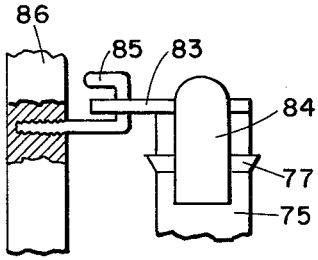
FIG. 8 is a side elevational view of the closure/sealing means of FIG. 6 and further illustrating it as a means for attaching the dispenser to a support.

FIGS. 6–8 illustrate another embodiment of a closure/sealing means which comprises a cylindrical body section 80, adapted to make a tight friction fit with the inner wall 81 of the opening end 82 of nozzle portion 75, and a gripping tab 83 which extends beyond the nozzle portion wall to provide a sufficiently large gripping surface to permit the closure/sealing means to be quickly withdrawn to free the powder dispensing opening. As will be seen in FIG. 8 an easily rupturable sealing tape 84 may be used to seal the closure/sealing means to the outer wall of the nozzle portion of the handle/nozzle section. Other types of closure/sealing means include, but are not limited to shrinkable plastic caps and weakened end walls which can be broken.

It is also within the scope of this invention to provide means to hang or suspend the dispenser on a wall or other suitable support. Thus FIG. 8 shows the use of a hook 85 fastened to a support 86 and adapted to pass through an opening 87 in tab 83 (FIG. 7). When the extinguisher is required, all that is necessary is to grasp it and tear it free from the closure/sealing means which remain engaged with hook 85.

Figure 9:
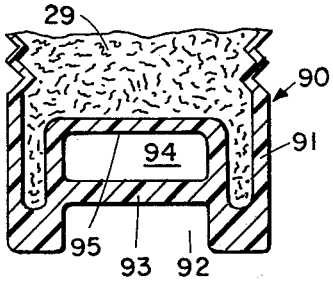
FIG. 9 illustrates another embodiment of the hand gripping section of the dispenser of this invention.
Figure 10:
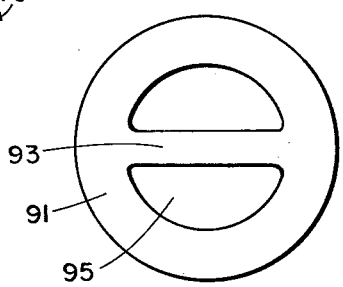
FIG. 10 is a bottom planar view of the hand gripping section of FIG. 9.

FIG. 9 is a fragmentary cross section of a dispenser constructed in accordance with this invention and having a modified hand gripping section. This hand gripping section, indicated generally by reference numeral 90, comprises a relatively deep, cup-shaped member 91 defining a well 92. Within well 92 a bar member 93 extends diametrically across the well from one side of the well to the other, (See also FIG. 10 which is a bottom planar view of the hand gripping means section of FIG. 9). The space 94 between bar 93 and well bottom 95 is of a dimension to permit the fingers of the gripping hand to pass through so that the hand may obtain a firm grip on bar 93. The dispenser of FIG. 9, which may otherwise be constructed as shown in FIGS. 3, 5 or 6, may be easily hung or suspended from a support by engaging bar 93 with a suitable hooking means.

Figure 11:
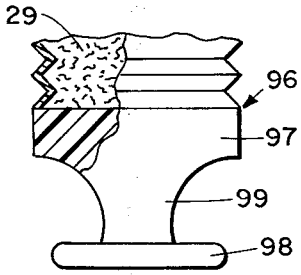
FIGS. 11 and 12 illustrate additional embodiments of the hand gripping section of the dispenser.
Figure 12:
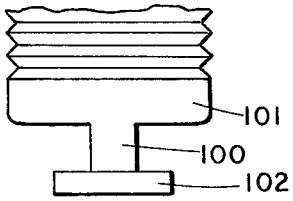

FIGS. 11 and 12 illustrate two additional hand gripping sections. In FIG. 11 the hand gripping section 96 comprises a base member 97 a circular platform member 98 and a hand gripping member 99 joining the base and platform members. In the embodiment of FIG. 11 the hand gripping section is constructed as a solid piece and gripping is achieved by grasping member 98.

The embodiment of FIG. 12 is somewhat similar to that of FIG. 11, except that it has a short, joining portion 100 between a base member 101 and a rod shaped grip 102. This dispenser is gripped by slipping joining portion 100 through the fingers and grasping rod grip 102.

Figure 13:
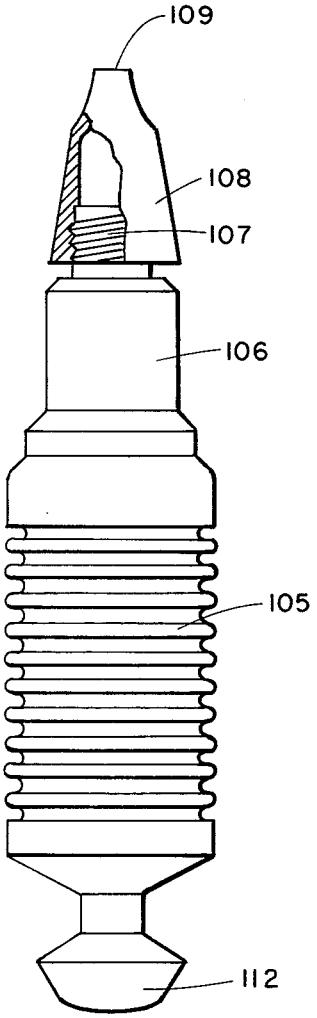
Fig. 13 Prior Art
FIGS. 13–16 illustrate side elevational and top plan views of prior art devices.
Figure 14:
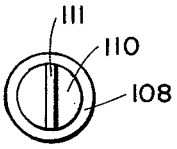
Fig. 14 Prior Art

FIGS. 13–16 illustrate the prior art devices known to applicants to be offered for sale. The device shown in FIGS. 13 and 14 is formed to have a relatively stiff-walled bellows section 105, the pleats of which have rounded edges. The upper section 106 terminates in a threaded opening 107 over which is screwed a nozzle piece 108 having across the opening 109 a diaphragm 110 defining a narrow powder discharge slit 111 (FIG. 14). The fire extinguisher of FIG. 13 terminates on the other end in a gripping member 112.

Figure 15:
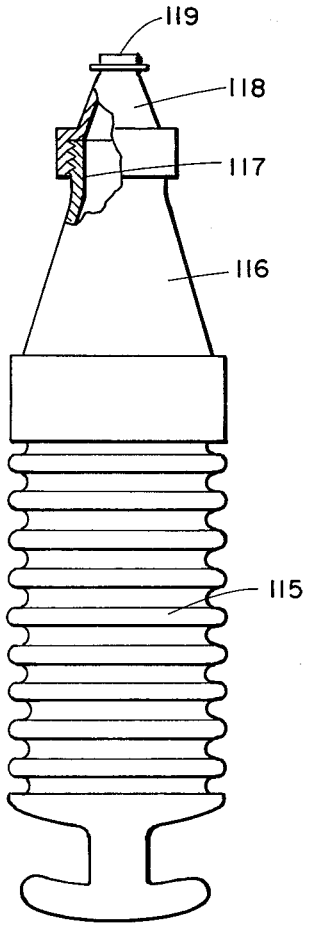
Fig. 15 Prior Art
Figure 16:
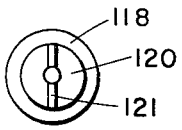
Fig. 16 Prior Art

In a similar manner, the device of FIGS. 15 and 16 is formed to have a stiff-walled bellows section 115, and a nozzle-gripping section 116 which terminates in a threaded section 117 over which is screwed a nozzle piece 118 having across the opening 119 a diaphragm 120 defining a narrow powder discharge slit 121 (FIG. 16).

From the above detailed description of the powder dispenser of this invention it will be seen that there is provided a device which is capable of rapidly and effectively discharging a finely divided solid material in cloud-like bursts. The dispenser of this invention is particularly suitable as a hand-held, hand-operably fire extinguisher.

It will thus be seen that the objects set forth above, among those made apparent from the preceding description, are efficiently attained, and, since certain changes may be made in the above article without departing from the scope of the invention, it is intended that all matter contained in the above description or shown in the accompanying drawings shall be interpreted as illustrative and not in a limiting sense.

We claim:

1. A hand-held and hand-operable powder dispenser, comprising in combination a. a container having a noncollapsible handle/nozzle section termination at its discharge end in an unobstructed powder dispensing opening of relatively large diameter sized to pass a cloud of dry powder therethrough and at its other end in a cylindrical band member, said handle/section having an internal configuration which permits the free flow of a powder therethrough;

b. a hand gripping section;

c. a central, thin-walled, flexible bellows section joining, through said cylindrical band member, said handle/nozzle section and said hand gripping section, said bellows section having a diameter essentially equal to said band member and being adapted to be collapsed and expanded axially to serve as a pump, the pleats forming said bellows section being joined to form relatively sharp edges; and d. readily removable closure/sealing means engageable with said powder dispensing opening; said handle/nozzle section fitting one hand of an operator while said operator graps said hand gripping section with the other hand to axially pump said central bellows section for dispensing dry powder contained therein in repeated cloud-like bursts.

2. A powder dispenser in accordance with claim 1 wherein said container is formed as a single unit.

3. A powder dispenser in accordance with claim 1 wherein said handle/nozzle section is formed as one unit and said central bellows section in combination with said hand gripping section is formed as another unit and means are provided to sealably join said units.

4. A powder dispenser in accordance with claim 1 wherein the internal wall of the powder discharge end of said handle/nozzle section is smoothly configured without sharp breaks and said powder dispensing opening has a cross sectional area and configuration conforming to that of said powder discharge end of said handle/nozzle section.

5. A powder dispenser in accordance with claim 1 wherein said container is formed of plastic.

6. A powder dispenser in accordance with claim 1 wherein said handle/nozzle section has an elongated conical configuration.

7. A powder dispenser in accordance with claim 6 wherein said handle/nozzle section has an external annular rib about midway along its length.

8. A powder dispenser in accordance with claim 1 including filling adapter means forming part of said handle/nozzle section and providing said power dispensing opening.

9. A powder dispenser in accordance with claim 1 wherein said hand gripping section comprises a closed end cylindrical member attached to said central bellows section and has an annular finger groove therearound.

10. A powder dispenser in accordance with claim 1 wherein said hand gripping section comprises a cup-shaped member defining a well and a rod-like gripping member extending across said well and joined to the internal wall of said cup-shaped member.

11. A powder dispenser in accordance with claim 1 wherein said hand gripping section comprises a base member, a rod-shaped grip member and a short section joining said base and grip members.

12. A powder dispenser in accordance with claim 1 wherein said closure/sealing means comprise a body portion sized to make a friction fit with said powder dispensing opening and a gripping tab attached to said body portion.

13. A powder dispenser in accordance with claim 12 wherein said closure/sealing means includes an aperture in said gripping tab, said aperture being sized to engage hook means whereby said closure/sealing means is removed from said power dispensing opening when said dispenser is withdrawn from said hook means.

14. A hand-held and hand-operable fire extinguisher, comprising in combination a. a container having a noncollapsible handle/nozzle section sized to fit one hand of an operator and terminating at its discharge end in an unobstructed powder dispensing opening of relatively large diameter and at its other end in a cylindrical band member;

b. a hand gripping section sized to fit the other hand of said operator;

c. a central, thin-walled, flexible bellows section joining, through said cylindrical band member, said handle/nozzle section and said hand gripping section, said bellows section having a diameter essentially equal to said band member and being adapted to be collapsed and expanded axially to serve as a pump, the pleats forming said bellows section being joined to form relatively sharp edges;

d. a quantity of a fire extinguishing, finely divided powder filling less than the entire volume of said container; and e. readily removable essentially air-tight closure/sealing means engageable with said powder dispensing opening; said quantity of said fire extinguishing powder, the size of said powder dispensing opening and the internal configuration of said handle/nozzle section being such that when said operator removes said closure/sealing means and grasps said handle/nozzle and said hand gripping sections to use said bellows as a pump said powder is repeatedly discharged from said dispenser in fire extinguishing effective cloud-like bursts.

15. A fire extinguisher in accordance with claim 14 wherein said handle/nozzle section is formed as one unit and said central bellows section in combination with said hand gripping section is formed as another unit and means are provided to sealably join said units.

16. A fire extinguisher in accordance with claim 15 wherein said means to sealably join said units comprises first threaded band means terminating said bellows section and second threaded band means in said cylindrical band member of said handle/nozzle means engageable with said first threaded band means.

17. A fire extinguisher in accordance with claim 1 wherein the internal wall of the powder discharge end of said handle/nozzle section is smoothly configured without sharp breaks and said powder dispensing opening has a cross sectional area and configuration conforming to that of said powder discharge end of said handle/nozzle section.

18. A fire extinguisher in accordance with claim 14 wherein said handle/nozzle section has an elongated conical configuration.

19. A fire extinguisher in accordance with claim 14 wherein said hand gripping section comprises a closed end cylindrical member attached to said central bellows section and has an annular finger groove therearound.

20. A fire extinguisher in accordance with claim 14 wherein said hand gripping section comprises a cup-shaped member defining a well and rod-like gripping member extending across said well and joined to the internal wall of said cup-shaped member.

21. A fire extinguisher in accordance with claim 14 wherein said closure/sealing means comprise a body portion sized to make a friction fit with said powder dispensing opening and a gripping tab attached to said body portion.

22. A hand-held fire extinguisher comprising, in combination a. a one-piece plastic container having an upper, truncated-conical handle portion terminating at its discharge end in a cylindrical neck with a dispensing opening having a relatively large diameter, adapted to pass a cloud of fire extinguishing dry powder and at its other end in a cylindrical band member;

b. a central, thin-walled, flexible, deformable bellows portion having a diameter essentially equal to said band member and being adapted to collapse and expand axially to serve as a pump, the pleats forming said bellows portion being jointed to form relatively sharp edges;

c. a lower handle portion having a deep, wide, annular finger groove extending therearound;

d. closure means fitting and sealing said dispensing opening; and e. a charge of dry fire extinguishing powder filling less than the entire volume of said container; said upper handle portion fitting one hand of an operator while the operator grips said lower handle portion with the other hand to axially pump said central bellows portion for dispensing said powder in repeated cloud-like bursts.

23. A hand fire extinguisher as specified in claim 22 wherein said powder fills about one-half of said volume, whereby when said container is held in pumping position said powder occupies substantially only the lower half thereof allowing air drawn in through said opening to be pumped thereover with each stroke of said bellows.

24. A hand fire extinguisher as specified in claim 22 wherein said dispensing opening is at least ⅜ inch in diameter; and said powder is of no greater than about one hundred mesh particle size mixture of monoammonium phosphate containing additives to render it noncaking, nonpacking and free-flowing.

25. A hand fire extingisher as specified in claim 22 wherein said closure means includes an adapter slidably fitting around said cylindrical neck and within the dispensing opening thereof, said adapter having an inside wall forming a funnel, or nozzle, and terminating in a second dispensing opening of less than said first opening.

26. A hand fire extinguisher as specified in claim 25 wherein said cylindrical neck includes an outwardly projecting annular integral bead and said adapter is of deformable plastic and includes an inwardly projecting annular integral bead adapted to slide over and snap lock behind said neck bead.

27. A hand fire extinguisher as specified in claim 25 wherein the inside wall of said adapter includes a cylindrical portion of large diameter merging with a terminal portion of reduced diameter to create back pressure.

* * * * *